United States Patent [19]

Stachejko

[11] 4,160,220

[45] Jul. 3, 1979

[54] PRECISION MICROWAVE DELAY CIRCUIT AND METHOD

[75] Inventor: Vitaly Stachejko, Willingboro, N.J.

[73] Assignee: RCA Corporation, New York, N.Y.

[21] Appl. No.: 871,760

[22] Filed: Jan. 23, 1978

[51] Int. Cl.[2] ..... H01P 1/18; H01P 11/00; H01P 3/08

[52] U.S. Cl. ..... 333/161; 29/600; 333/246

[58] Field of Search ..... 333/31 R, 31 A, 84 M, 333/84 R, 9, 97 R, 98 R, 81 R, 81 A, 22 R; 324/57 R, 58 R, 58 A, 58 B, 58 C

[56] References Cited

U.S. PATENT DOCUMENTS

| | | | |
|---|---|---|---|
| 3,136,946 | 6/1964 | Levine | 333/84 R X |
| 3,581,245 | 5/1971 | Ohi | 333/22 R |
| 3,585,533 | 6/1971 | Denhard | 333/22 R |
| 3,656,179 | 4/1972 | Deloach | 333/31 R |

*Primary Examiner*—Alfred E. Smith
*Assistant Examiner*—Marvin Nussbaum
*Attorney, Agent, or Firm*—Samuel Cohen; William Squire

[57] ABSTRACT

A resistive material in the evanescent field of a transmission line, such as microstrip line, is employed to vernier adjust the phase delay introduced by the line. While the phase delay is being measured, the position of the resistive material, which is being held in place by cement which has not yet set, is altered, until the precise phase delay desired is reached, and then the cement is permitted to harden. The resistive material employed is of the type normally used as an absorber, such as Eccosorb, and its resonant frequency is a fraction of the signal frequency.

13 Claims, 2 Drawing Figures

PRECISION MICROWAVE DELAY CIRCUIT AND METHOD

Figure 1:
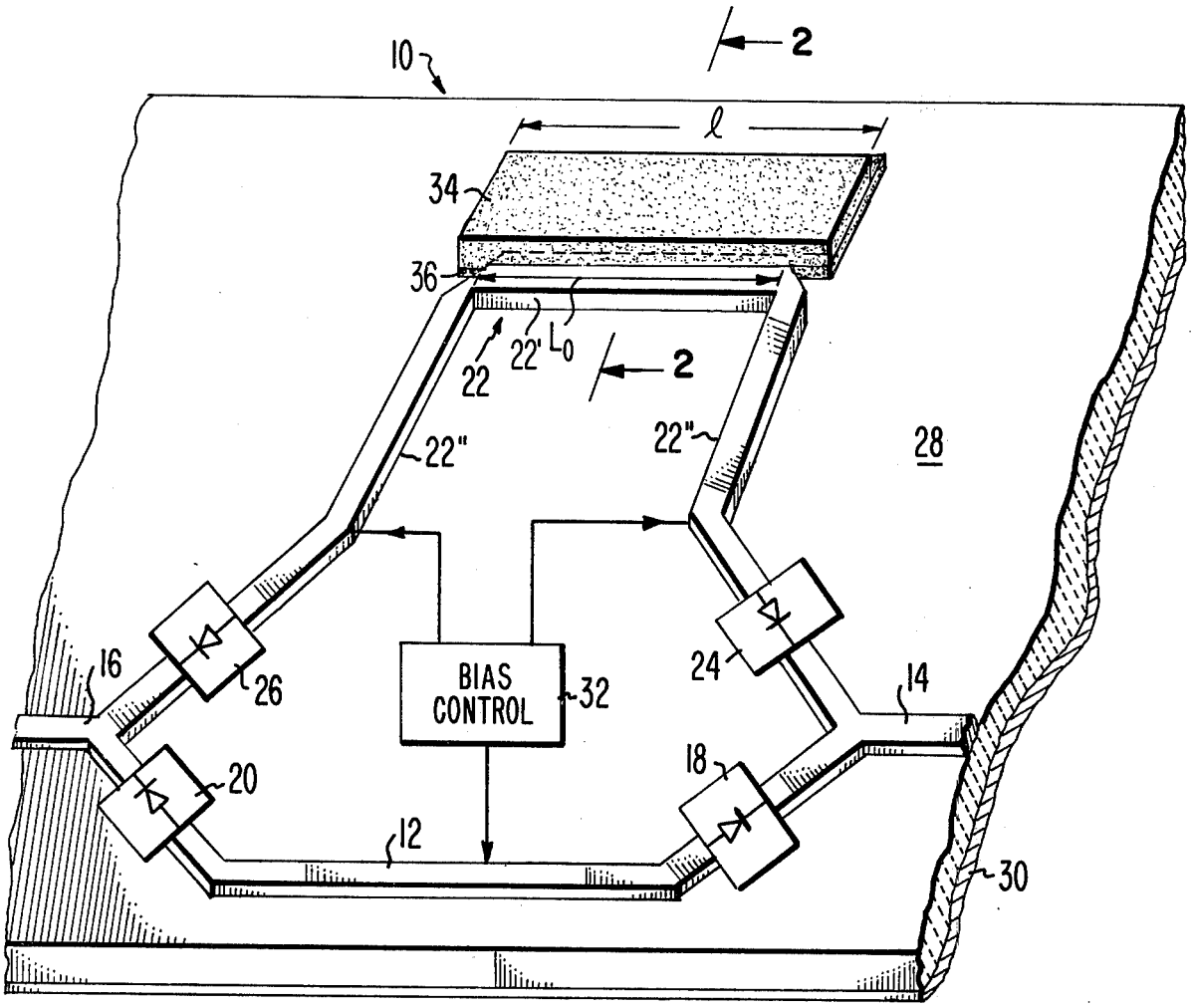

The present invention relates to circuits for delaying signals such as employed in microwave phase shifters.

The phase of a microwave signal may be shifted by changing the electrical length of the path through which the signal is transmitted. Phase shifters operating on this principle have many applications, one being in phased array radar systems. A typical such system may employ several antenna systems and thousands of phase shifters, and by controlling the latter, the radar beam may be scanned to a given position in a given direction, and the scanning direction changed very rapidly.

In microwave phase shifters of the type described above, switches such as diodes or ferrites are employed for changing the electrical path length and they are located in transmission paths which may comprise coaxial lines, strip lines, microstrip lines or waveguides, as examples. Several types of diode phase shifters are available and include switched line, hybrid coupled, loaded line and three element "$\pi$" or "T" closed circuits. The switched line constant loss phase shifter includes first and second transmission lines on a microstrip circuit wherein each line is connected to an input terminal and an output terminal via a switching diode, usually a PIN type. A bias control circuit switches first one line and then the other line in alternate sequence between the input and output terminals. More details of the construction an operation of diode phase shifters may be found in: J. F. White, "Diode Phase Shifters for Array Antennas," *IEEE Transactions on Microwave Theory and Techniques,* Vol MTT-22, No. 6, June 1974, Pages 658–674; and R. V. Garver, "Broad-Band Diode Phase Shifters," *IEEE Transactions on Microwave Theory and Techniques,* Vol. MTT-20, No. 5, May, 1972, Pages 314–323.

One application for the switched diode phase shifter is the generation of a serial bit stream. A system for performing this function may include a plurality of phase shifters connected in series, each introducing a phase shift which is one-half that of the next downstream phase shifter. When fabricated in microwave strip line form, the transmission lines for the successive bits of the multiple bit sequence are successively greater physical length. However, present day manufacturing techniques are such that it is extremely difficult to form such phase shifters in microstrip form within the desired electrical tolerances. Slight variations in line length or material electrical constants results in significant differences in phase delay. For example, a fraction of an inch change in length or a small change in the material dielectric constant can result in a phase delay error in the order of degrees. Present manufacturing tolerances usually are in the range of 5°–10° in the L band. The accuracy decreases inversely with frequency. To manufacture a microstrip phase shifter of this type to the accuracy in the order of a fraction of the degree is extremely difficult and virtually impossible without costly repetitive manufacturing recycling steps.

In the manufacture of a multiple bit phase shifter such as described above, because there are very small variations that occur naturally in the manufacturing process which can cause significant electrical variations in the transmitted signal, it is generally not possible, in advance, to know whether the system will meet the manufacturing specifications. Therefore, each system must be tested and if any phase shift is found to be inaccurate, the transmission line causing the error has to be measured and its length corrected and possibly other changes made in the system. This trial and error technique is slow and costly.

Phase adjusting systems for dealing with the problem above have been devised in the past, but these usually are complex and introduce impedances mismatches, insertion losses, and other undesirable characteristics into the transmission line.

The method and apparatus of the present invention permits the delay introduced into a transmission line, such as the microwave strip line of a microwave phase shifter such as described above, to be controlled with a very high degree of precision. A resistive element, such as one formed of a material which normally is employed as an absorber, is positioned in the evanescent field of the transmission line. By controlling the position of the element relative to the transmission line, the delay introduced by the line can be vernier controlled to a fraction of a degree, even at frequencies over 1000 MHz.

IN THE DRAWING

Figure 2:
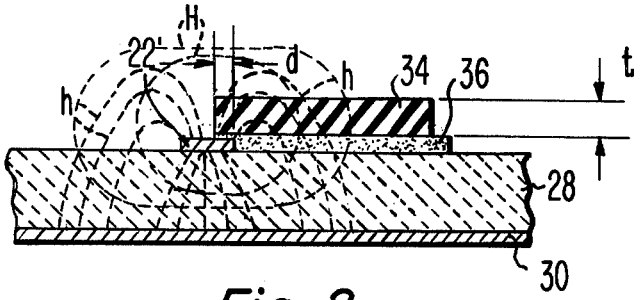

FIG. 1 is an isometric, partially schematic, view of a microstrip switched diode phase shifter in accordance with one embodiment of the present invention, and FIG. 2 is a sectional view taken along lines 2—2 of the embodiment of FIG. 1.

FIG. 1, which is a pictorial representation of an embodiment of a switched diode phase shifter 10, shows one of a series of serially connected phase delay circuits, each producing a bit in the transmitted signal. The array may comprise, for example, a six-bit phase shifter wherein phase shifts are 180°, 90°, 45°, 22½°, 11¼° and 5/6°. In this system, the least significant bit, the 5.6° phase shift, determines the accuracy of the system. To provide such accuracy in prior art microstrip switch diode phase shifters has been virtually impossible. As explained in the introductory portion, to mechanically produce a phase shifter to an accuracy of better than 10°–20° is an extremely difficult task and is beyond the capabilities of present day manufacturing techniques to produce a transmission line on a substrate to that accuracy.

The electrical circuit of phase shifter 10 is in the form of the well-known switched diode phase shifter. The electrical network is preferably of the conventional microstrip construction including a first narrow conductor 12 connected between an input conductor 14 and an output conductor 16. A pair of switching diodes 18 and 20 are, respectively, located in the opposite extremities of conductor 12. A second narrow conductor 22 of greater length than conductor 12 is connected between input and output conductors 14 and 16. Switching diodes 24 and 26 are, respectively located in the opposite extremities of conductor 22. The diodes are connected to open or close an electrical path between conductors 14, and 16. Conductors 12, 22, 14 and 16 and diodes 18, 20, 24 and 26 are on one broad surface of a dielectric substrate 28. A ground plane 30, of electrically conductive material is fixed to the opposite bottom broad surface of the substrate 28. The conductors 14, 12, and 16 and 22 are typically a thin layer of conductive material formed by well-known techniques such as thin film deposition of a conductor material which is subsequently etched utilizing conventional resist methods to form the desired configuration. In the preferred embodiment, the conductors and ground plane are formed of copper or gold and the dielectric substrate 28 is formed of alumina ceramic, although other materials having suitable properties for this purpose may also be used.

The path taken by the signal (conductor 22 or conductor 12) determines the phase shift introduced to the signal propagating between conductors 14 and 16. A bias control 32 provides a bias signal which concurrently forward biases one pair of diodes 24, and 26 (to permit conduction through line 22) while at the same time, reverse biasing the other pair of diodes 18 and 20 (to open circuit line 12) or vice versa. The condition of the pairs of diodes is changed during successive periods of operation. Bias control 32 and the diodes 18, 20, 24, and 26 are conventional.

The switching action of diodes 18 and 26 can be made at an extremely fast rate for example, 80 MHz. Ordinarily P-I-N diodes are used as switching diodes. In the present embodiment diodes 18, 20, 24 and 26 may be made of very fast switching Schottkey barrier diodes. Other types of diodes or switching elements may, however, be used to achieve the switching.

The difference in length between conductors 22 and 12 is proportional to the difference between their respective phase shifts. A relatively small phase shift for the least significant bit in a six-bit system can have a conductor 22 length slightly greater than the conductor 12 length. As the phase shift doubles for each successive bit so does the length of conductor 22 double for each corresponding transmission line to produce that successive bit. The extremely accurate adjustment of the phase-shift or setting of the actual electrical length of conductor 22 in any or all of the phase shifters is provided by the following construction embodying the present invention.

Highly resistive, absorbing material 34 is mounted via cement 36 on the substrate 28 surface and positioned adjacent the conductor 22. Conductor 22 includes first and second legs 22'' of approximately equal length and a third leg 22' connecting the legs 22''. While the material 34 is shown overlapping conductor 22' a distance d, this is by way of illustration only. In practice, the actual position of the material 34 will depend upon the amount of phase correction (delay) desired. In some cases in which the phase correction needed is small, the material 34 may be in the evanescent field of line 22', but spaced a small distance away from the line rather than overlapping it. It should be mentioned, in passing, that the elements in FIG. 1 are not drawn to scale. The conductors, for example, may be a layer of 0.0003 inches thick, the thickness t of material 34 may be 0.067 inches and the cement layer (not shown) may be 0.002 inches thick.

The material 34 has a number of particular characteristics which are especially useful in providing an adjustable delay of a microwave frequency signal without additional attenuation and impedance mismatch. With respect to the impedance of the transmission line of FIG. 1, the characteristic impedance may be any value and, in this example, is 50 ohms. Securing of material 34 to the surface of substrate 28 adjacent conductor 22 does not significantly alter this impedance. Material 34, which may be a highly resistive silicon rubber, provides a delay for the microwave frequency signal propagating on the conductor 22. For a 50 ohm line, material 34 may have a thickness t, of 0.067 inches. A suitable material 34 is commercially available from Emerson and Cuming, Inc., 59M Walpole Street, Canton, Mass. under the tradename "Eccosorb." It is a resonant, flexible, silicone rubber-based, high dielectric and high permeability energy absorbing material which is often used as an absorber for microwave signals. When used as an absorber, backed by metal, and the signal is applied at normal incidence to the absorber, there is 100 percent attenuation of the signal whose frequency is at the resonant frequency $f_r$, of the material 34. The material 34 resonant frequency $f_r$, and thus the frequency at which full absorption occurs, is a function of its thickness and density.

The element 34 is not used as an absorber or terminator in the present system. Rather it is employed as a delay means and in this use, there is negligible attenuation of the incident signal. Eccosorb material at a thickness of 0.067 inches is an absorber for a microwave signal at $f_r$ of 4000 MHz. The frequency of the signal propagated on the phase shifter in one practical design using this thickness of Eccosorb was 1300 MHz. Thus, there was an approximately three-to-one frequency ratio between the material 34 resonant frequency $f_r$ and the frequency of the signal propagated by the transmission line.

An additional characteristic of the material which is of significance is that the material has an effective permeability constant $\mu_r$ that is relatively close to its effective dielectric constant $E_r$. For example, it is believed that the ratio of relative values of $\mu_r$ and $E_r$ is between 0.8 and 1.2. It is known that a microstrip transmission line impedance $Z_0$ is related to the inductance L and the capacitance C per unit length of the microstrip transmission line as follows:

$$Z_O = \sqrt{\frac{L}{C}} \tag{1}$$

It is also known that the impedance of free space is $$Z_O = \sqrt{\frac{\mu_O}{E_O}} \tag{2}$$

where $\mu_0$ is permeability and $E_0$ is the dielectric constant. The impedance for free space is approximately 376.7 ohms. The impedance $Z_0$ of the transmission lines of FIG. 1 was given above as 50 ohms. It might appear that the addition of the material 34 within the free space region adjacent the conductor 22' in the evanescent field of the signal propagating along the conductor would alter the impedance of the transmission line, cause a mismatch and result in undesirable reflections. However, this is believed not to occur for the reasons that the impedance $Z_0$ of the transmission line is related to permeability $\mu_r$ and the dielectric constant $E_r$ $$Z_O = \frac{L}{C} \quad \sqrt{\frac{\mu_r}{E_r}} \tag{3}$$

for a unit length of transmission line. When $\mu_r$ and $E_r$ are close in value it is seen that they will not alter the value of the impedance $Z_0$. FIG. 2 shows undistorted electric and magnetic fields h and H respectively and how approximately they intercept the material 34. Note that the fields h and H surrounding conductor 22', produced by the propagating signal intercepts the material 34 at nearly right angles. It is believed that when this occurs there is relatively little attenuation of the signal on conductor 22' by the material 34. The velocity of propagation $V_g$ of a signal on a transmission line is $$V_g = \frac{V_O}{\sqrt{E_r}} \quad (4)$$

where $V_g$ is the velocity of propagation on the strip-line of a given signal, $V_0$ is the velocity of propagation in free-space, and $E_r$ is the dielectric constant of the substrate material. This equation is altered by the addition of material 34 as follows:

$$V_g = \frac{V_O}{\sqrt{E_r(\mu_{r1}E_{r1})}} \quad (5)$$

where $\mu_{r1}$ is the relative permeability of material 34 and $E_{r1}$ is the relative dielectric constant of the material 34. Thus, it is seen that the velocity of propagation is inversely altered by the material 34. It has been found that by making the ratio of resonant frequency $f_r$ of the material 34 with respect to the frequency of the signal propagating on the transmission line about (2.5/1) to (3/1); instead of the material 34 attenuating the signal, it merely delays it.

As seen above the ratio ($\mu_r/E_r$) determines the reactive insertion loss or mismatch due to material 34. By making the values of these factors relatively close as indicated above, relatively little mismatch is introduced into the transmission line.

In one example, the material 34 was made of 0.067 inches thick sheet of Eccosorb cemented to a microstrip transmission line using Dow Corning 3140 RTV cement which is workable for 30 minutes having a thickness of about 2 mils and overlapping the conductor 22' distance d 0.018 inches. The conductors 22, 14, 12 and 16 were gold printed 0.0003 inches thick on an alumina substrate and were 0.05 inches wide. The overlap produced a 12° phase shift at 1500 MHz. The VSWR was measured at 1.023 to 1.048 over a 1200 to 1500 MHz frequency range and less than 0.1 db of increase in insertion loss was measured. By cementing material 34 to the substrate 28 with a cement 36 that is workable for a 30 minute period and observing the phase-shift signal produced by the transmission line 22 on a suitable test equipment, such as a Hewlet-Packard network analyzer, the material 34 can be accurately positioned with respect to the conductor 22. It is found in practice, that the phase shift can be controlled, using this approach, to within the accuracy of the test instrument which itself is a high precision instrument which can measure a phase difference of a fraction of a degree.

As already implied, the material 34 intercepts the fields h and H produced by the signal propagating on the conductor 22'. By increasing distance d, the length $L_0$ of conductor overlap by the material 34 can be decreased for a given phase shift. A length l of the material 34 does not have to coincide with the overlap length $L_0$, and for small phase shifts, say less than a degree, material 34 need not overlap the conductor 22.

If the entire length of conductor 22 between diodes 24 and 26 were fully covered with the material 34 then a phase shift of approximately 45° can be introduced.

Since the phase shift introduced by the material 34 can be visually observed on a suitable test instrument prior to the permanent securing of the material 34 to the substrate, any desired phase shift can be set into the system in accordance with a particular requirement.

The layer of cement 36 used to cement the material 34 to substrate 28 should be kept as thin as possible to prevent the introduction of undesirable electrical variations as the cement cures. This thickness is not critical. The dielectric constant of material 34 is estimated to be approximately 26 when all electric field is within the material. The effective dielectric constant for the aluminum substrate 28 for a 50 ohm transmission line is about 6.5 or 10 when all electric field is within the substrate.

The overall operation of a switched diode phase shifter of the type described herein is well-known and need not be repeated here. A six-bit phase shifter built in accordance with the present invention has a phase shift of 5.6° representing the least significant bit at a measured error of approximately 0.2°. It is thus, therefore, apparent that the system employing the present invention may provide phase shifts when the least significant bit has a phase shift of only 1.4° or even less. That is, a 10 bit precision phase modulator can be realized. Thus, an extremely accurate phase-shift is provided that is relatively simple to construct and of low cost. Such a system has an accumulated error that has been measured to be not greater than 0.4° in a six-bit system switching at a 80 MHz rate. Because of the accurate setting of each phase shift in a multi-bit system, a microwave phase modulator in integrated circuit form exhibiting unprecedented accuracy over an octave band width can be realized which permits direct economical conversion of a digitized wave form to microwave frequencies, a key element in wideband wave form generation schemes for advanced radar. This circuit is also applicable to direct arithmetic frequency synthesis in communication systems.

What is claimed is:

1. In a microwave delay circuit, in combination:
a transmission line having a given impedance;
an input terminal coupled to said line to which a signal at a given microwave frequency, which it is desired to delay, may be applied;
an output terminal spaced from said input terminal, also coupled to said line; and
resistive means having an electromagnetic radiation resonance at a microwave frequency sufficiently different than said given microwave frequency so that negligible microwave energy at said given frequency is attenuated by said resistive means, said resistive means being positioned adjacent a portion of said transmission line between said input and output terminals, and having a dielectric constant and a permeability sufficiently close in value so as to have negligible effect on said given impedance, whereby said resistive means delays a microwave signal at said given frequency, when such a signal is applied to said input terminal and is propagating along said portion of said transmission line, an amount dependent upon the position of said resistive means with respect to said transmission line and upon the values of said dielectric constant and permeability and with negligible impedance mismatch and negligible attenuation of said microwave signal.

2. In a microwave delay circuit according to claim 1 said resistive means being positioned to delay said signal less than a degree.

3. In a microwave delay circuit according to claim 1, said transmission line comprising a microstrip transmission line including a narrow conductor on one plane surface of a plane dielectric substrate and a relatively wider ground conductor on opposite plane surface of said substrate.

4. In a microwave delay circuit according to claim 1, said resistive means comprising a plane sheet of loaded silicon-rubber material.

5. In a microwave delay circuit according to claim 1 said resistive material overlapping at least a portion of said transmission line.

6. In a microwave delay circuit, according to claim 1, said resistive material intercepts the electric field adjacent said line approximately normal to the direction of propagation of said signal on said transmission line.

7. In a microwave delay circuit, according to claim 1, said signal given frequency being not more than about 2/5 of the resonance frequency of said resistive means.

8. A method of vernier adjusting the phase delay introduced to a microwave signal propagating along a transmission line comprising the steps of:

placing in the evanescent field of the transmission line, on a layer of cement which has not yet set, an element formed of resistive material of the type which introduces an amount of delay in the signal transmission, dependent upon the position of resistive material;

while measuring the delay being introduced to the signal, adjusting the position of the element until the precise delay desired is obtained; and then permitting the adhesive to harden while the element is in its final position.

9. The method as set forth in claim 8, wherein said element comprises Eccosorb.

10. The method as set forth in claim 8, wherein said element has a resonant frequency which is a fraction of that of the signal.

11. A method of vernier adjusting the phase delay introduced to a microwave signal propagating along a microstrip transmission line which includes a ground plane, a dielectric on one surface of the ground plane and a strip line on the other surface of the dielectric comprising the step of:

placing in the evanescent field of the transmission line, on a layer of cement on the dielectric which layer has not yet set, an element formed of resistive material of the type which introduces an amount of delay in the signal transmission, dependent upon the position of resistive material;

while measuring the delay being introduced to the signal, adjusting the position of the element until the precise delay desired is obtained; and then permitting the adhesive to harden while the element is in its final position.

12. The method as set forth in claim 11, wherein said element is adjusted to a position such that it overlaps the strip line.

13. The method as set forth in claim 11, wherein said element has a resonant frequency which is a fraction of that of the signal and has a dielectric constant which is close in value to its permeability.

* * * * *

UNITED STATES PATENT AND TRADEMARK OFFICE
CERTIFICATE OF CORRECTION

PATENT NO. : 4,160,220
DATED : July 3, 1979
INVENTOR(S) : Vitaly Stachejko

It is certified that error appears in the above-identified patent and that said Letters Patent is hereby corrected as shown below:

Column 4, Equation 2 "$Z'_0$" should be --$Z_0$,--.

Column 4, Equation 3 "$\frac{L}{C}\sqrt{\frac{\mu_r}{E_r}}$ should be

-- $\frac{L}{C} \propto \sqrt{\frac{\mu_r}{E_r}}$ --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*